US008784098B2

(12) United States Patent
Komiyama et al.

(10) Patent No.: US 8,784,098 B2
(45) Date of Patent: Jul. 22, 2014

(54) SHELF ASSEMBLY FOR FIRING

(75) Inventors: Tsuneo Komiyama, Toki (JP); Nobuhiro Matsumoto, Toki (JP)

(73) Assignees: NGK Insulators, Ltd., Nagoya (JP); NGK Adrec Co., Ltd., Kani-Gun (JP)

( * ) Notice: Subject to any disclaimer, the term of this patent is extended or adjusted under 35 U.S.C. 154(b) by 688 days.

(21) Appl. No.: 12/619,924

(22) Filed: Nov. 17, 2009

(65) Prior Publication Data

US 2010/0133220 A1 Jun. 3, 2010

(30) Foreign Application Priority Data

Dec. 1, 2008 (JP) ..... 2008-306115

(51) Int. Cl.
*F27D 5/00* (2006.01)
*C21D 9/00* (2006.01)

(52) U.S. Cl.
USPC ..... 432/258; 432/261

(58) Field of Classification Search
USPC ..... 211/186, 189, 183; 432/258, 259, 261
See application file for complete search history.

(56) References Cited

U.S. PATENT DOCUMENTS

| | | | | | |
|---|---|---|---|---|---|
| 1,492,188 | A | * | 4/1924 | Young | 165/80.5 |
| 2,118,641 | A | * | 5/1938 | Diamond | 432/241 |
| 2,246,448 | A | * | 6/1941 | Mahan, Jr. | 432/259 |
| 2,567,609 | A | * | 9/1951 | Lovatt | 432/259 |
| 3,664,513 | A | * | 5/1972 | Atwater | 211/134 |
| 3,739,921 | A | * | 6/1973 | Schmidt | 211/194 |
| 3,756,581 | A | * | 9/1973 | Albertini | 432/258 |
| 3,759,661 | A | * | 9/1973 | Barsby | 432/241 |
| 4,013,403 | A | * | 3/1977 | Petrus | 432/239 |
| 4,110,069 | A | * | 8/1978 | Lovatt | 432/258 |
| 4,462,798 | A | * | 7/1984 | Foster | 432/258 |
| 4,487,579 | A | * | 12/1984 | Irwin | 432/241 |
| 4,526,537 | A | * | 7/1985 | Rumbach | 432/239 |
| 4,721,460 | A | * | 1/1988 | Bushman et al. | 432/241 |
| 5,185,982 | A | * | 2/1993 | Hostetler | 52/646 |
| 5,393,226 | A | * | 2/1995 | Groom | 432/258 |
| 5,704,134 | A | * | 1/1998 | Carter et al. | 34/396 |
| 5,785,519 | A | * | 7/1998 | Becker et al. | 432/258 |
| 5,836,760 | A | * | 11/1998 | Turner et al. | 432/253 |
| 5,848,890 | A | * | 12/1998 | McCormick | 432/261 |

(Continued)

FOREIGN PATENT DOCUMENTS

| | | |
|---|---|---|
| DE | 43 29 468 C1 | 2/1995 |
| JP | 02-010116 Y2 | 3/1990 |

(Continued)

OTHER PUBLICATIONS

Chinese Office Action dated Jan. 30, 2013 (with English translation).

*Primary Examiner* — Joshua J Michener
*Assistant Examiner* — Devin Barnett
(74) *Attorney, Agent, or Firm* — Burr & Brown, PLLC

(57) ABSTRACT

A shelf assembly for firing including plural struts for supporting shelf boards arranged upright in two or more rows in a cross direction and in three or more rows in a longitudinal direction on a longitudinally-long car with tie-beams connecting the struts. A thermal stress relief structure is provided in which the struts arranged upright in the adjacent rows in the longitudinal direction are connected only with tie-beams slanted in a cross direction between the struts, with the thermal stress relief structure preventing warpage or damage of the struts resulting from a bending stress generated in the longitudinal direction at the fixing parts of the struts.

9 Claims, 4 Drawing Sheets

(56) References Cited

U.S. PATENT DOCUMENTS

| | | | | |
|---|---|---|---|---|
| 6,216,893 | B1 * | 4/2001 | Lee | 211/189 |
| 6,644,966 | B1 * | 11/2003 | Chiang | 432/253 |
| 6,837,235 | B2 * | 1/2005 | Blankenship | 126/337 R |
| 7,384,264 | B2 * | 6/2008 | Ego et al. | 432/261 |
| 8,087,931 | B2 * | 1/2012 | Erhard | 432/258 |
| 8,133,049 | B1 * | 3/2012 | Sullivan et al. | 432/258 |
| 2003/0010739 | A1 * | 1/2003 | Konstant | 211/189 |
| 2008/0138754 | A1 * | 6/2008 | Erhard | 432/258 |
| 2010/0133220 | A1 * | 6/2010 | Komiyama et al. | 211/183 |

FOREIGN PATENT DOCUMENTS

| | | | |
|---|---|---|---|
| JP | 05-030949 | B2 | 5/1993 |
| JP | 06-127643 | A1 | 5/1994 |
| JP | 07-196110 | A1 | 8/1995 |
| JP | 11-257876 | A1 | 9/1999 |

* cited by examiner

SHELF ASSEMBLY FOR FIRING

BACKGROUND OF THE INVENTION

1. Field of the Invention

The present invention relates to a shelf assembly for firing.

2. Description of the Prior Art

With regard to shelf assemblies for firing ceramic, a shelf assembly has been known that is provided with struts on a kiln car, each of the struts having plural projecting sides for mounting shelf boards and the shelf boards being mounted on the projecting sides (Patent Document 1, for example). Conventionally, in order to stabilize the struts extending in a vertical direction on a kiln car, there have been adopted a method of inserting the tops of struts in an upper plate having strut insertion holes to secure the struts as described in Patent Document 1 and a method of securing the tops of struts 2 supported by a car 3 with tie-beams 4 as shown in FIG. 1.

In these conventional methods, however, the bottoms of struts are immovably secured to the car-top with footing members. When thermal expansion occurs on shelf components during firing processing, a large load is applied especially to the upper ends of struts located in the vicinity of the longitudinal ends to thereby generate a bending stress, and the bending stress causes large distortion on the struts, resulting in warpage or damage of the struts. Conventionally, as a mechanism for relieving such a stress, a margin for accommodating thermal expansion was provided by designing the diameter of holes for inserting bolts to be larger than bolt diameters. However, it was not preferable to design the diameter of holes for inserting bolts to be larger than bolt diameters, because it caused new problems such as vibrations to the shelf assembly.

[Patent Document 1] Japanese Unexamined Patent Publication No. 11-257876

SUMMARY OF THE INVENTION

An object of the present invention is to solve the above-mentioned problems and to provide a shelf assembly for firing which can prevent warpage or damage of struts resulting from a bending stress generated in a longitudinal direction at the fixed parts of struts whose tops are secured.

A shelf assembly for firing according to a first aspect of the present invention includes: plural struts for supporting shelf boards arranged upright in two or more rows in a cross direction and three or more rows in a longitudinal direction on a longitudinally-long car; and tie-beams connecting between the upper ends of the struts. The shelf assembly has a thermal stress relief structure in which the struts are arranged upright in adjacent rows in the longitudinal direction and are connected only with the tie-beams slanted in the cross direction between the struts.

According to a second aspect of the present invention, the shelf assembly for firing according to the first aspect is provided, where the thermal stress relief structure is incorporated in the whole shelf assembly.

According to a third aspect of the present invention, the shelf assembly for firing according to the first aspect is provided, where the thermal stress relief structure is incorporated in a part of the shelf assembly.

According to a forth aspect of the present invention, the shelf assembly for firing according to the first aspect is provided, where the thermal stress relief structure is incorporated in a central portion in a longitudinal direction of the shelf assembly.

According to a fifth aspect of the present invention, the shelf assembly for firing according to any one of the first through the fourth aspects is provided, the tie-beams constituting the thermal stress relief structure decussate with each other.

A shelf assembly for firing according to the present invention has a thermal stress relief structure in which struts are connected only with tie-beams slanted in a cross direction between the struts, thereby scattering a stress generated in the longitudinal direction of the shelf assembly in the cross direction to relieve it and solving the problems such as warpage or damage of struts resulting from a longitudinal stress load. Conventionally, as a stress relief mechanism, a margin for accommodating thermal expansion was provided by designing the diameter of holes for inserting bolts to be larger than bolt diameters. But the margin for accommodating thermal expansion caused new problems, such as vibration of the shelf assembly. The stress relief mechanism according to the invention does not cause problems such as vibration.

In order to scatter a longitudinal stress load in the cross direction most effectively, it is preferable to incorporate a thermal stress relief structure in the whole shelf assembly. On the other hand, by incorporating a thermal stress relief structure in a part of the shelf assembly, the effect of the invention can be obtained while the conventional shelf assembly structure is used as it is wherever possible. In the case where a thermal stress relief structure is incorporated in a part of the shelf assembly, a longitudinal stress load is scattered in the cross direction more effectively by incorporation of the thermal stress relief structure in a central portion in the longitudinal direction of the shelf assembly. In addition, the tie-beams constituting a thermal stress relief structure preferably decussate with each other.

DETAILED DESCRIPTION OF THE INVENTION

Figure 1:
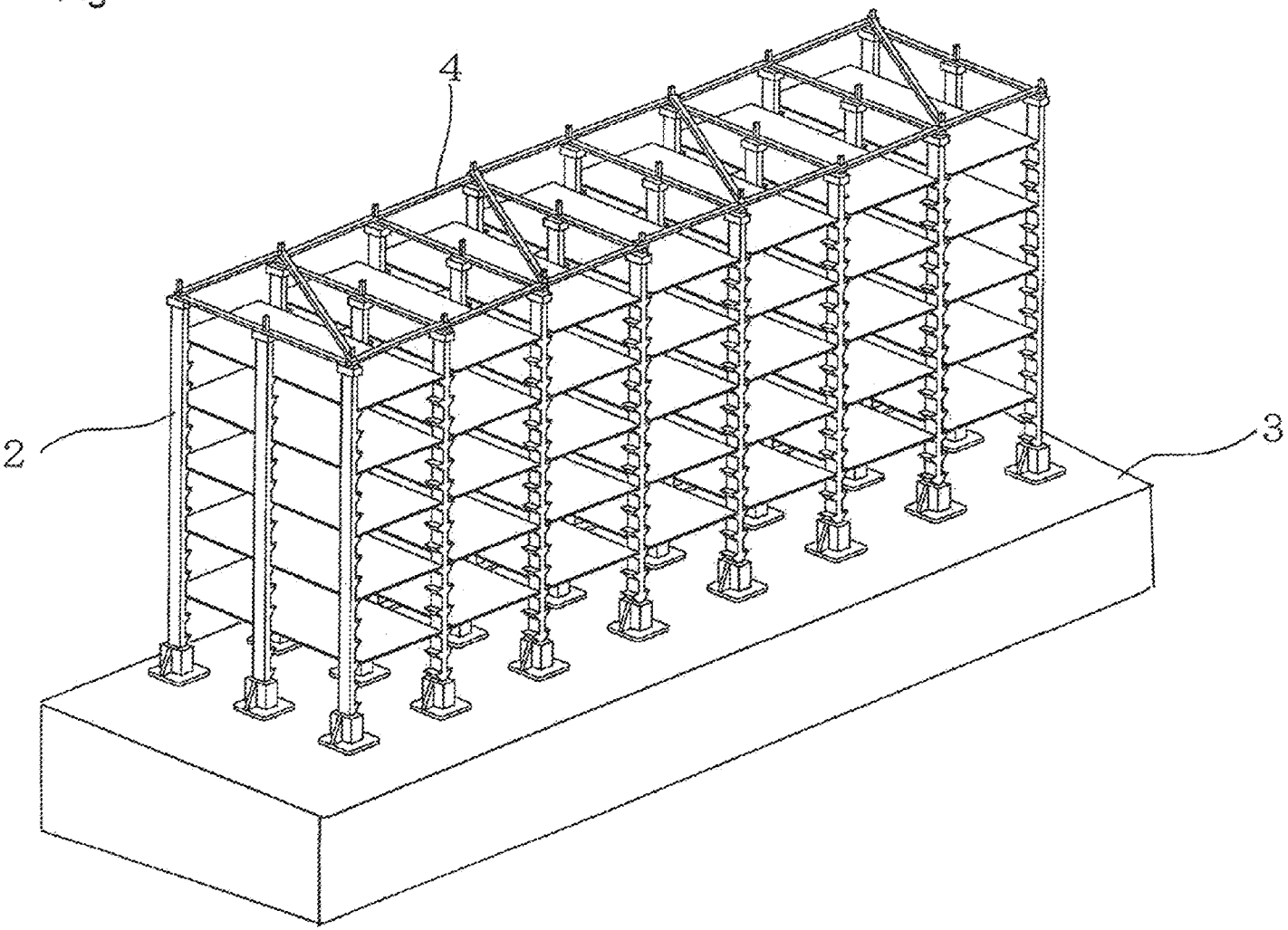
FIG. 1 is an illustrative view of the structure of a conventional shelf assembly for firing.
Figure 2:
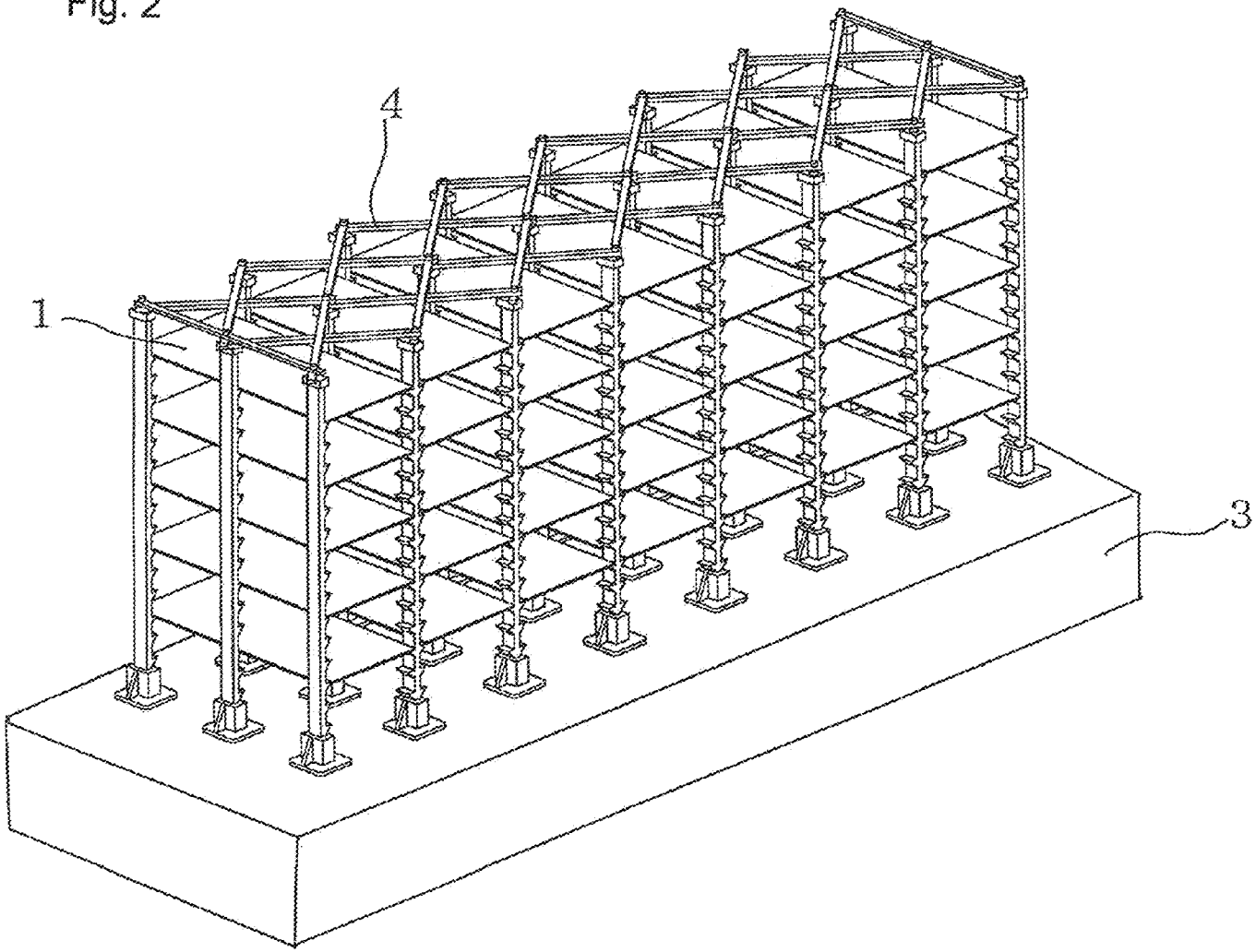
FIG. 2 is an illustrative view of the structure of a shelf assembly for firing of the present invention.

FIG. 2 is an illustrative view of the structure of a shelf assembly for firing of the present invention.

The shelf assembly for firing of the present invention has a structure in which struts 2 for supporting shelf boards 1 are arranged upright in two or more rows in a cross direction and three or more rows in a longitudinal direction on a longitudinally-long car 3, each of the struts 2 being connected to other struts with at least two tie-beams 4, and furthermore, a thermal stress relief structure 5 is incorporated in at least one portion of the self assembly. The thermal stress relief structure 5 in the present invention is a structure in which the struts arranged upright in adjacent rows in the longitudinal direction are connected only with the tie-beams 4 slanted in a cross direction between the struts. In order to scatter a longitudinal stress load in the cross direction, the oblique angle of the tie-beams 4 can be set within the range of 10 to 80 degrees with respect to the longitudinal direction. In order to scatter a longitudinal stress load in the cross direction effectively, the angle is preferably set within the range of 30 to 60 degrees, and most preferably at 45 degrees.

Figure 3:
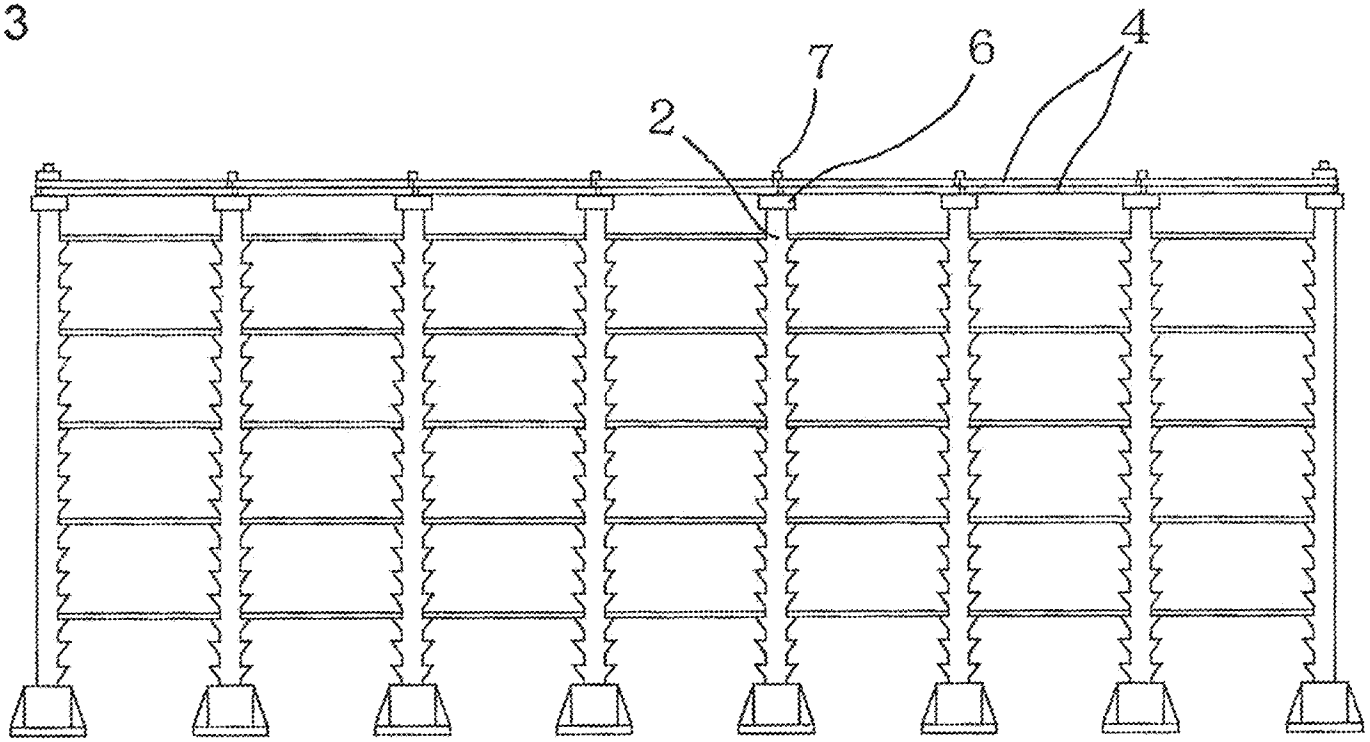
FIG. 3 is a longitudinal side view of the shelf assembly for firing of the present invention.

The shelf boards 1, struts 2 and tie-beams 4 are made of refractory materials such as silicon carbide. The refractory materials are not specifically limited, but from the aspect of refractory materials for a shelf assembly for firing, it is more preferable that they have the following physical properties: an apparent porosity of 0.1 to 20%, a bulk density of 2.5 to 3.5 and Young's modulus of 200 to 400 GPa. The bottoms of struts 2 are secured on the car 3, and the tops of struts 2 are connected to other struts 2 with at least two tie-beams 4. As shown in FIG. 3, the connection structure of the tops of struts 2 is provided by superposing a hole formed on the top of strut 2, a hole formed on a cap 6 which is used to cover the top of strut 2, and a hole formed at the joint of the tie-beams 4, and then inserting a cap pin 7 through the superposed holes. Such a cap pin insertion structure achieves a greater stress relief effect. However, the present invention is not limited to such a cap pin insertion structure, and a stress relief effect of the invention is also achievable by a structure in which a cap and a pin are integrated or a structure having only tie-beams.

Figure 4:
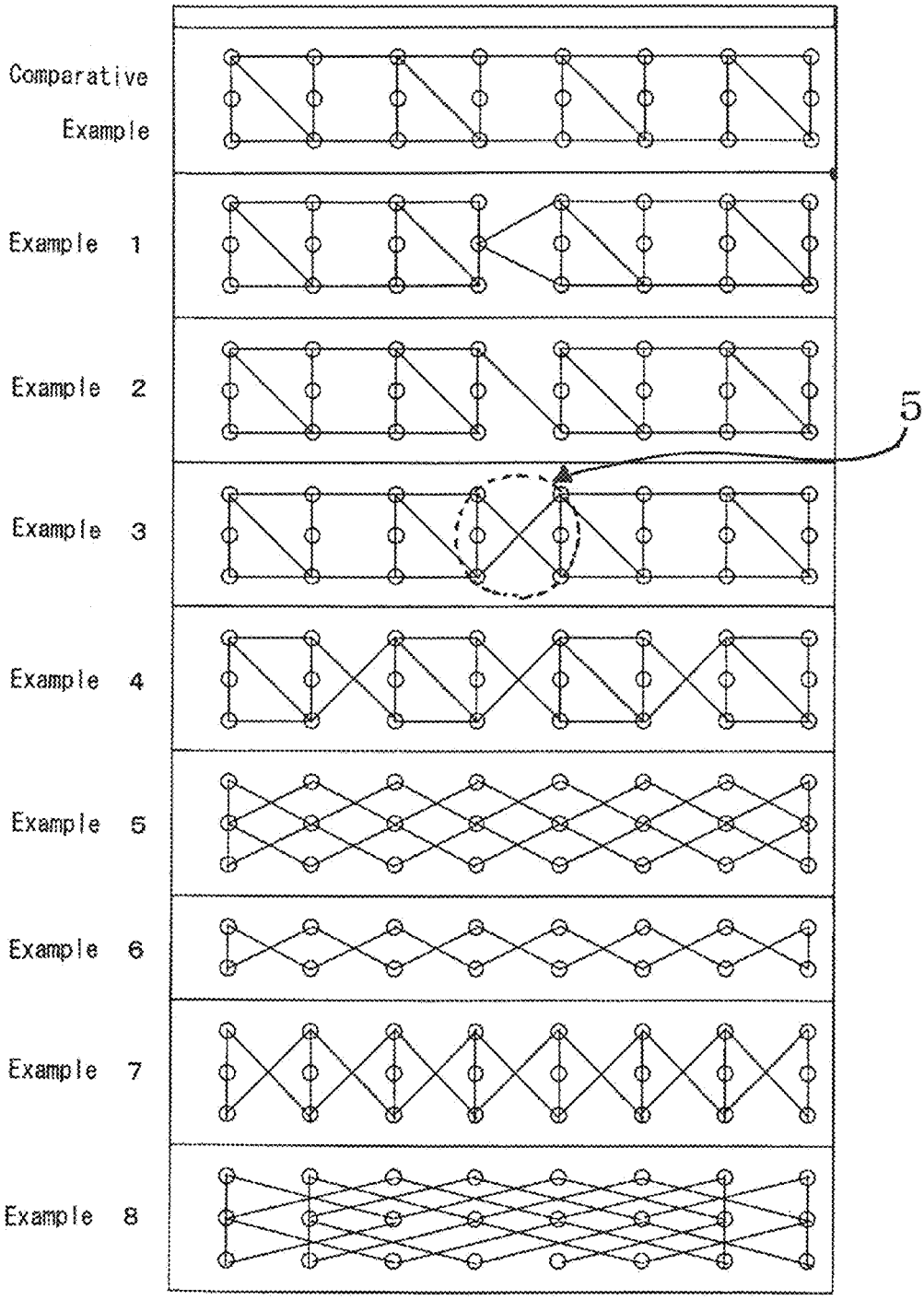
FIG. 4 is a view showing models of struts connection with tie-beams.

FIG. 4 shows the connection models of struts 2 in a conventional shelf assembly for firing (Comparative Example) and a shelf assembly for firing of the present invention (Examples 1 to 8). Comparative Example does not include a thermal stress relief structure 5 in which longitudinally adjoining struts are connected only with tie-beams slanted in a cross direction. In Examples 1 to 3, a thermal stress relief structure 5 is incorporated in a central portion in a longitudinal direction of the shelf assembly, and in Examples 5 to 8, a thermal stress relief structure 5 is incorporated in the whole shelf assembly.

Shelf assemblies for firing having the strut connection structures according to the strut connection models shown in FIG. 4 (Comparative Example, Examples 1 to 8) were made. The structure dimension of every shelf assembly was: 5000 mm in length×1000 mm in breadth×2000 mm in height. Table 1 below shows the ratio of each longitudinal bending stress generated at the tops of struts in Examples 1 to 8 (assuming that the longitudinal bending stress generated at the tops of struts in Comparative Example is 100%) and the breakage rate in the case where each shelf assembly is used in firing (firing temperature: 1300° C., frequency of use: 100 times/year).

As shown in Table 1, according to the present invention (Examples 1 to 8), a greater stress relief effect is achieved compared to the prior art (Comparative Example), and problems such as warpage or damage of struts can be solved.

TABLE 1

| | Stress ratio | Breakage rate |
|---|---|---|
| Comparative Example | 100% | 10% |
| Example 1 | 29% | 0.5% |
| Example 2 | 43% | 1% |
| Example 3 | 29% | 0.5% |
| Example 4 | 14% | 0.01% |
| Example 5 | 14% | 0.01% |
| Example 6 | 14% | 0.01% |
| Example 7 | 14% | 0.01% |
| Example 8 | 29% | 0.5% |

The invention claimed is:

1. A shelf assembly for firing comprising:

a plurality of struts for supporting shelf boards arranged upright in two or more rows in a cross direction and in three or more rows in a longitudinal direction on a longitudinally-long car;

a plurality of tie-beams connected between all of the upper ends of the struts, wherein at least each respective set of end struts arranged in two or more rows in the cross direction are connected by a tie-beam from the plurality of tie-beams which is not slanted in the cross direction; and at least one thermal stress relief structure in which two of the plurality of struts arranged upright in the three or more rows in the longitudinal direction are connected only by tie-beams from the plurality of tie-beams, and those tie-beams are slanted in a cross direction between the struts, whereby the at least one thermal stress relief structure prevents at least one of warpage and damage of the struts by reducing longitudinal bending stress that is generated at tops of the struts when the shelf assembly is used for firing.

2. A shelf assembly for firing according to claim 1, wherein corresponding struts arranged upright in each row in the longitudinal direction are connected by the at least one thermal stress relief structure.

3. A shelf assembly for firing according to claim 1, wherein corresponding struts arranged upright in some rows in the longitudinal direction are connected by the at least one thermal stress relief structure.

4. A shelf assembly for firing according to claim 1, wherein only one thermal stress relief structure connects corresponding struts arranged upright in central rows in the longitudinal direction.

5. A shelf assembly for firing according to claim 1, wherein the tie-beams constituting the at least one thermal stress relief structure decussate with each other.

6. A shelf assembly for firing according to claim 2, wherein the tie-beams constituting the at least one thermal stress relief structure decussate with each other.

7. A shelf assembly for firing according to claim 3, wherein the tie-beams constituting the at least one thermal stress relief structure decussate with each other.

8. A shelf assembly for firing according to claim 4, wherein the tie-beams constituting the at least one thermal stress relief structure decussate with each other.

9. A shelf assembly for firing according to claim 1, wherein the slanted tie-beams of the at least one thermal stress relief structure connect struts arranged in directly adjacent rows.

* * * * *